US009700990B2

(12) United States Patent
Lee et al.

(10) Patent No.: US 9,700,990 B2
(45) Date of Patent: Jul. 11, 2017

(54) NOZZLE AND DEVICE FOR HIGH-SPEED GENERATION OF UNIFORM NANOPARTICLES

(71) Applicant: POSTECH ACADEMY-INDUSTRY FOUNDATION, Pohang-si, Gyeongsangbuk-do (KR)

(72) Inventors: Jin Won Lee, Pohang-si (KR); In Ho Kim, Busan (KR)

(73) Assignee: POSTECH ACADEMY-INDUSTRY FOUNDATION, Pohang-si, Gyeongsangbuk-Do (KR)

( * ) Notice: Subject to any disclaimer, the term of this patent is extended or adjusted under 35 U.S.C. 154(b) by 12 days.

(21) Appl. No.: 14/651,964

(22) PCT Filed: Oct. 25, 2013

(86) PCT No.: PCT/KR2013/009554
§ 371 (c)(1),
(2) Date: Jun. 12, 2015

(87) PCT Pub. No.: WO2014/098364
PCT Pub. Date: Jun. 26, 2014

(65) Prior Publication Data

US 2015/0321314 A1 Nov. 12, 2015

(30) Foreign Application Priority Data

Dec. 18, 2012 (KR) ..... 10-2012-0148975

(51) Int. Cl.
*B24C 1/00* (2006.01)
*B24C 5/04* (2006.01)

(52) U.S. Cl.
CPC ..... *B24C 1/003* (2013.01); *B24C 5/04* (2013.01)

(58) Field of Classification Search
CPC ..... B24C 1/003; B24C 5/04
(Continued)

(56) References Cited

U.S. PATENT DOCUMENTS 2,583,726 A * 1/1952 Chalom ..... B24C 5/04 239/427
4,461,454 A * 7/1984 Vadnais ..... B05C 17/002 222/521
(Continued)

FOREIGN PATENT DOCUMENTS

JP 63-266836 A 11/1988
JP 2002-079145 A 3/2002
(Continued)

OTHER PUBLICATIONS

JPO Office Action for Japanese Application No. 2015-549241 which corresponds to the above-referenced U.S. application.
(Continued)

*Primary Examiner* — Arthur O Hall
*Assistant Examiner* — Viet Le
(74) *Attorney, Agent, or Firm* — LRK Patent Law Firm

(57) ABSTRACT

A nozzle, a device, and a method for high-speed generation of uniform nanoparticles allow a particle generation gas formed of carbon dioxide to pass through the nozzle, thereby forming uniform nanoparticles at high speed. An orifice that adjusts an opening and closing cross-sectional area of a throat of the nozzle is provided to cause uniform nuclei generation without an additional cooling device, a dilating portion that has a cross-sectional area and a dilation angle increasing toward an outlet side of the nozzle is provided to grow the nuclei through a first dilation portion (having a relatively gradual dilation angle) and thus cause particle generation, and the generated particles are accelerated
(Continued)

through a second dilating portion that has a steeper dilation angle than the first dilating portion.

9 Claims, 4 Drawing Sheets

(58) Field of Classification Search
USPC ..... 239/272, 433, 593
See application file for complete search history.

(56) References Cited

U.S. PATENT DOCUMENTS 4,545,317 A * 10/1985 Richter ..... B05B 7/1486 114/222
4,574,586 A * 3/1986 Gabrysch ..... F02K 7/18 137/468
5,062,898 A 11/1991 McDermott et al.
2010/0102139 A1* 4/2010 Hursen ..... E21B 7/18 239/11
2012/0125954 A1* 5/2012 Fisenko ..... F04F 5/46 222/566

FOREIGN PATENT DOCUMENTS

JP 2006-130406 A 5/2006
KR 10-2004-0101948 A 12/2004
KR 10-2006-0079561 A 7/2006
KR 10-0662241 B1 12/2006
KR 10-2009-0050707 A 5/2009
KR 10-2010-0135107 A 12/2010

OTHER PUBLICATIONS

Search Report for International Application No. PCT/KR2013/009554.

* cited by examiner

NOZZLE AND DEVICE FOR HIGH-SPEED GENERATION OF UNIFORM NANOPARTICLES

TECHNICAL FIELD

The present invention relates to a nozzle, a device and a method for generating high-speed uniform nanoparticles, and more specifically, to a nozzle, a device and a method for generating high-speed uniform nanoparticles, which can generate nanoparticles of a uniform size in a room temperature condition and inject the nanoparticles at a high speed.

BACKGROUND ART

The present invention relates to a nozzle, a device and a method for generating high-speed uniform nanoparticles. Although the present invention can be used for a variety of usages such as removing nano-pollutants, digging a groove of a nano-size, adjusting roughness of a surface and the like, background arts of the present invention will be described hereinafter focusing on a micro particle generation and injection device used in a dry washing device since it is general that the high-speed micro particle generation and injection device is frequently used in a dry washing device targeting Flat Display Panels (FDPs), semiconductor elements or the like.

A washing device or method can be largely classified as a wet washing method or a dry washing method. The dry washing method among the methods means a method of generating sublimation particles and dropping and removing pollutants by injecting the sublimation particles onto the surface of a contaminated object.

In generating the sublimation particles, a method of supplying a gas, a liquid or a mixture of a gas and a liquid to a nozzle, transforming the gas, the liquid or the mixture into solid particles and injecting the particles is generally used.

U.S. Pat. No. 5,062,898 has disclosed a surface washing method using aerosol of an extremely low temperature. Specifically, this is a method of forming argon gas into aerosol by expanding a mixture gas and washing a surface of an object, and it includes a heat exchange process for cooling down the aerosol to a liquefaction point to implement an extremely low temperature of the aerosol.

On the other hand, Korean Laid-opened Patent No. 10-2006-0079561 has disclosed a washing device for generating solid particles using carbon dioxide and argon by providing a separate cooling device and injecting the solid particles using a carrier gas. In addition, Korean Laid-opened Patent No. 10-2004-0101948 has disclosed an injection nozzle including a separate heating device for heating the carrier gas.

On the other hand, performance parameters of the dry washing device are determined by a size of a washing particle, uniformity of the size, a number density, an injection speed and the like.

First, from the aspect of the size of a washing particle, a size of a sublimation particle should be small in proportion to the size of a pollutant to be washed. Sublimation particles of a nano-size are required to remove pollutants of a size smaller than 100 nm.

In addition, from the aspect of washing power, injection speed of the sublimation particles should be high to have a high washing power, and a supersonic speed is required to remove pollutants of 10 nm class.

However, the dry washing device according to the prior art described above has a problem in that the size and speed of a particle is highly limited.

First, when sublimation particles are generated using argon gas, the argon gas should be supplied after being precooled as much as close to a liquefaction temperature of nitrogen by providing a separate cooling device, and thus the speed of injecting the sublimation particles should be reduced. In addition, since it is difficult to control the temperature when the argon gas is precooled, there is a problem in that sublimation particles of high number density and uniformity are difficult to generate.

Contrarily, when the sublimation particles are generated using carbon dioxide, it is advantageous in that the sublimation particles can be generated comparatively easily at a room temperature without separately controlling the temperature. However, although sublimation particles larger than a micro-size can be easily generated using the carbon dioxide, there are a lot of technical difficulties in generating sublimation particles of a nano-size.

DISCLOSURE OF INVENTION

Technical Problem

Therefore, the present invention has been made in view of the above problems, and it is an object of the present invention to provide a nozzle, a device and a method for generating high-speed uniform nanoparticles, which can significantly enhance washing efficiency by generating sublimation particles of a nano-size at a room temperature without a separate cooling device and, at the same time, injecting the sublimation particles at an extremely high speed.

Technical Solution

A nozzle, a device and a method for generating high-speed uniform nanoparticles according to the present invention conceived to accomplish the above object generate the high-speed uniform nanoparticles by passing a particle generation gas formed of carbon dioxide through the nozzle, which is characterized by inducing generation of uniform nuclei without an additional cooling device by providing an orifice for adjusting an opening and closing cross-sectional area of a nozzle throat, facilitating generation of particles by providing a dilating portion having a cross-sectional area and a dilation angle increasing toward an outlet side of the nozzle and growing the nuclei through a first dilating portion having a relatively gentle dilation angle, and accelerating the generated particles through a second dilating portion having an acute dilation angle compared with the first dilating portion.

Advantageous Effects

The present invention has an effect of significantly enhancing washing efficiency by generating sublimation particles of a nano-size at a room temperature without a separate cooling device and, at the same time, injecting the sublimation particles at an extremely high speed.

More specifically, generation of nuclei of high number density and uniformity can be induced without a separate cooling device through rapid expansion of a particle generation gas by providing an orifice.

In addition, sublimation particles of a nano-size can be formed by growing nuclei generated through a first dilating portion having a gentle dilation angle, and the formed particles can be accelerated by expanding the particles at an increased dilation angle through a second dilating portion.

In addition, the washing efficiency can be enhanced furthermore by providing a third dilating portion and adjusting a separation point, and proximity to a washing object can be enhanced by obliquely cutting the outlet surface of the nozzle.

DESCRIPTION OF SYMBOLS

Figure 1:
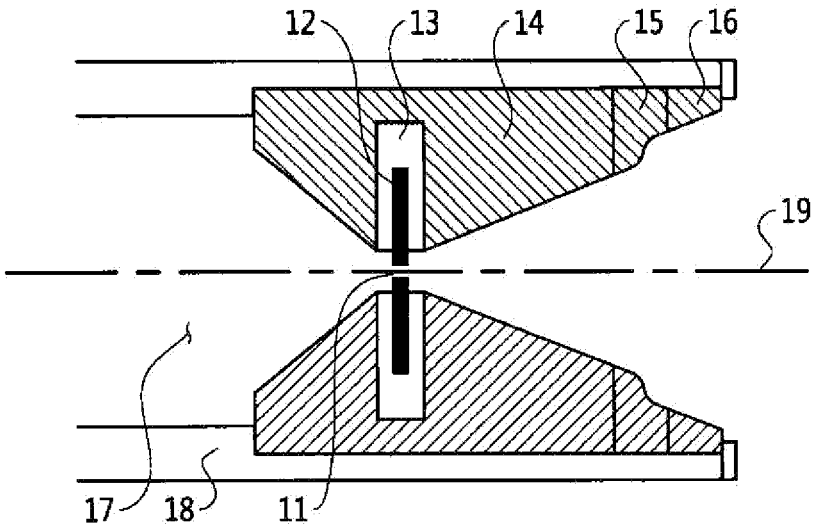
FIG. 1 is a cross-sectional view showing a nozzle for generating high-speed uniform nanoparticles according to an embodiment of the present invention.

1: Object
10: Nozzle
11: Nozzle throat
12: Orifice
13: Orifice block
14: First dilating portion
15: Second dilating portion
16: Third dilating portion
17: Gas supply tube
18: Heat insulation unit
19: Nozzle axis
20: Pressure controller
30: Mixing chamber
40: Particle generation gas storage unit
50: Carrier gas storage unit
$\theta_1$, $\theta_2$, $\theta_3$: Dilation angle
$\theta_4$: Cutting angle

BEST MODE FOR CARRYING OUT THE INVENTION

Hereafter, specific contents for embodying the present invention will be described in detail with reference to the accompanying drawings.

Figure 2:
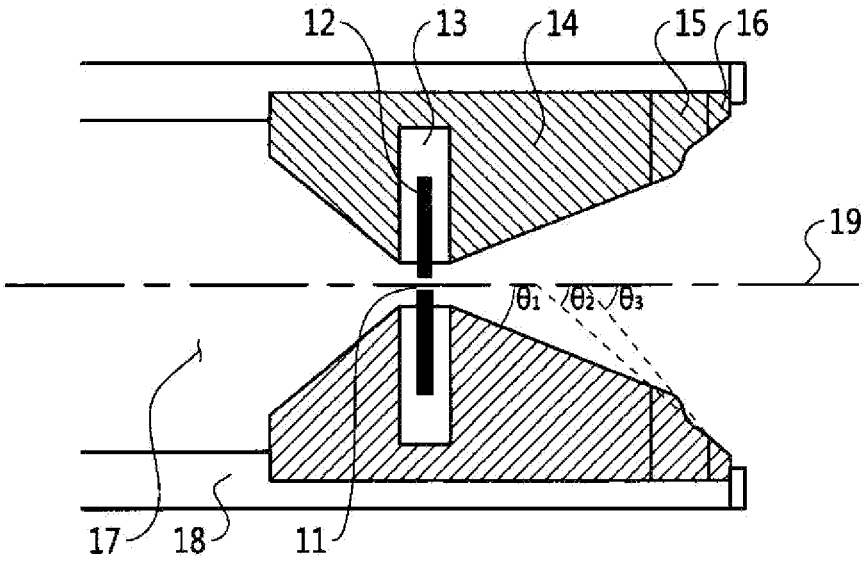
FIG. 2 is a cross-sectional view showing a dilation angle of a dilating portion of a nozzle for generating high-speed uniform nanoparticles according to an embodiment of the present invention.

FIGS. 1 and 2 are cross-sectional views schematically showing a nozzle for generating high-speed uniform nanoparticles according to an embodiment of the present invention.

A nozzle for generating high-speed uniform nanoparticles according to an embodiment of the present invention is configured to include an orifice 12 provided in a nozzle throat 11 and a dilating portion extended from the outlet of the nozzle throat 11.

First, the orifice 12 reduces the cross-sectional area of the nozzle throat 11 to a microscopic hole by adjusting the opening and closing cross-sectional area of the nozzle throat 11. A particle generation gas (or a mixture gas of a particle generation gas and a carrier gas) passing through the orifice 12 rapidly expands and generates nuclei of a nano-size.

In addition, although it is described that the orifice 12 is provided in the nozzle throat 11, since the nozzle throat 11 herein means a portion where the cross-sectional area is narrowest in the nozzle 10, a case of combining only the orifice 12 at the inlet side of the dilating portion is also included. That is, the orifice 12 itself may be regarded as a nozzle throat 11.

On the other hand, in the case of a nozzle of a device for generating particles according to the prior art, a process of cooling down the particle generation gas should be necessarily included for generation of nuclei, whereas in the case of the nozzle 10 according to the present invention, generation of nuclei can be induced at a room temperature without a separate cooling device by providing an orifice 12 having a microscopic hole to rapidly expand the particle generation gas. In addition, and it may be also possible to generate nuclei of a uniform size as the particle generation gas rapidly expands.

In addition, the orifice 12 may be formed in a shape of an aperture capable of adjusting the size of the microscopic hole, as well as in a shape having a microscopic hole of an invariable size, and, on the other hand, a method of adjusting the size of the microscopic hole by providing the orifice 12 mounted in the nozzle 10 in a replaceable form may also be considered.

In addition, the nozzle for generating high-speed uniform nanoparticles according to the present invention includes a dilating portion provided at the outlet side of the nozzle throat 11 or the outlet side of the orifice 12. The dilating portion is formed in a shape increasing the cross-sectional area toward the outlet side, unlike the particle generation nozzle of the prior art. The particle generation nozzle of the prior art is formed in a shape repeatedly increasing and decreasing the size of the cross-sectional area for growth of particles.

More specifically, the dilating portion is configured to include a first dilating portion 14 and a second dilating portion 15 respectively having a dilation angle different from the other.

The first dilating portion 14 preferably has a dilation angle $\theta_1$ of 0° to 30°, and as growth of nuclei is accomplished while the particle generation gas passes through a first dilating portion 14. The first dilating portion 14 is formed to have a comparatively gentle dilation angle $\theta_1$ compared with the second dilating portion 15 and provides a sufficient time for the nuclei to grow.

Although the first dilating portion 14 is formed to be comparatively long at a comparatively gentle dilation angle $\theta_1$ and induces growth of nuclei, it invites reduction of flowing speed since an effective area is reduced as the boundary layer is increased. Accordingly, the second dilating portion 15 capable of obtaining an additional accelerating force is installed to compensate the reduction of speed.

An average dilation angle $\theta_2$ of the second dilating portion 15 is preferable a dilation angle $\theta_2$ increased by 10° to 45° compared with the dilation angle $\theta_1$ of the first dilating portion 14. Since the second dilating portion 15 is formed to have an acute dilation angle compared with the first dilating portion 14 and forms a high area ratio between the inlet and the outlet, the particles are sufficiently accelerated. On the other hand, since the second dilating portion 15 does not have a single dilation angle unlike the first dilating portion 14 and a third dilating portion, the angle is referred to as an average angle.

If the dilation angle at the connection portion of the second dilating portion 15 is changed significantly in steps when the second dilating portion 15 is extended from the first dilating portion 14, an internal shock wave will bw generated. Accordingly, the second dilating portion 15 is preferably formed in a shape having curves. Further specifically, the connection portion for connecting the second dilating portion 15 to the first dilating portion 14 is formed to have a dilation angle the same as the dilation angle $\theta_1$ of the outlet side of the first dilating portion 14, and the connection portion is formed to gradually increase the dilation angle toward the center of the second dilating portion 15 to form an acute inclination angle near the center and decrease the dilation angle from the center toward the outlet side of the second dilating portion 15 so that generation of the internal shock wave may be prevented.

Although it may be considered that the dilating portion of the nozzle for generating high-speed uniform nanoparticles according to an embodiment of the present invention is configured to include the first dilating portion 14 and the second dilating portion 15 as described above, on the other hand, it may be considered to further include a third dilating portion 16.

The third dilating portion 16 is connected to the outlet of the second dilating portion 15 and forms a final outlet of the dilating portion. The third dilating portion 16 performs a function of adjusting a separation point of internal flow inside the nozzle 10.

It is preferable that the third dilating portion 16 has a dilation angle $\theta_3$ increased by 10° to 45° compared with the dilation angle $\theta_2$ of the second dilating portion 15 and lower than 90° in maximum.

If back pressure at the rear end of the nozzle 10 is low, a flow field may additionally grow since a separation point goes farther from the nozzle throat 11, and thus it is preferable to form the third dilating portion 16 to induce the separation point to be positioned at the end portion of the dilating portion while securing a sufficient length at the same time. It is since that washing efficiency can be increased greatly by forming the high-speed core (isentropic core) outside the nozzle 10.

On the other hand, if the back pressure at the rear end of the nozzle 10 is formed to be high, it may be regarded that the flow field has already grown sufficiently since the separation point comes closer to the nozzle throat 11, and thus it is preferable to expose the high-speed core at the outside of the nozzle 10 by reducing the length of the third dilating portion 16.

Meanwhile, the outer surface of the nozzle 10 is preferably wrapped with a heat insulation unit 18. The heat insulation unit 18 is configured of an external insulation tube and an insulating material filled therein. The heat insulation unit 18 accelerates growth of particles by maintaining thermal resistance of the nozzle 10 and, at the same time, provides mechanical strength by forming an outer wall so that the nozzle 10 may endure a high pressure gas. In addition, it is preferable that they are formed in one piece to wrap the whole side surface of the nozzle 10.

Figure 3:
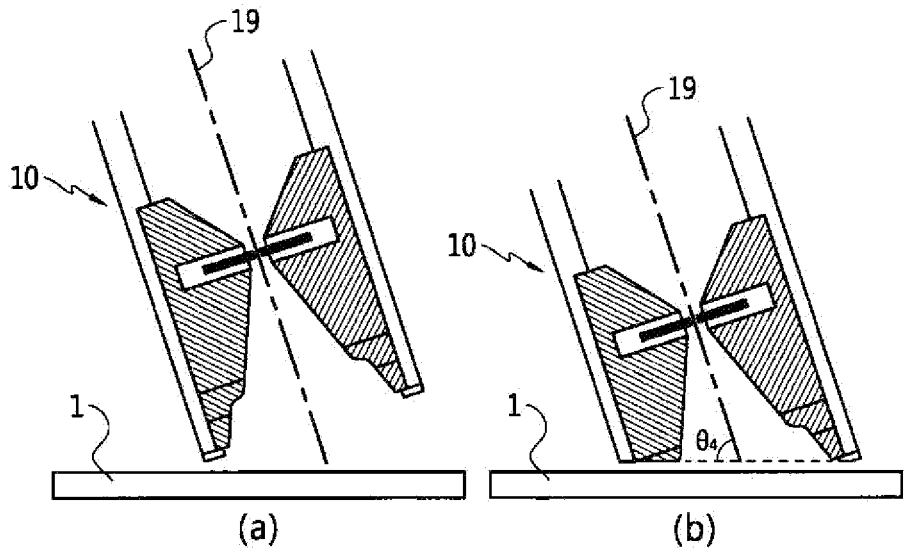
FIG. 3 is a conceptual view of a proximity relation between a nozzle for generating high-speed uniform nanoparticles according to an embodiment of the present invention and an object.

Meanwhile, FIG. 3 is a conceptual view showing a proximity relation between a nozzle for generating high-speed uniform nanoparticles according to an embodiment of the present invention and an object 1.

FIG. 3(*a*) is a view showing a positional relation between the outlet surface of the nozzle 10 and the object 1 of a general case, and FIG. 3(*b*) is a view showing the outlet surface of the nozzle obliquely cut to approach the nozzle to the object 1 further closer.

As shown in FIG. 3(*a*), the nozzle 10 generally performs a washing work while being slanted at a predetermined angle. In this case, there is a problem in that washing efficiency is lowered since the outlet of the nozzle 10 cannot fully approach the object 1 due to the characteristic of a cylindrical shape.

Accordingly, in order to solve this problem, as shown in FIG. 3(*b*), it is preferable to provide the outlet surface of the nozzle 10 in a form obliquely cut so as to correspond to a working angle of the nozzle 10. The cutting angle $\theta_4$ of the shape cut as described above is preferably determined within a range of 20° to 90° with respect to the nozzle axis 19.

A nozzle for generating high-speed uniform nanoparticles according to an embodiment of the present invention has been described above. Hereinafter, a device for generating high-speed uniform nanoparticles including such a nozzle 10 will be described.

Figure 4:
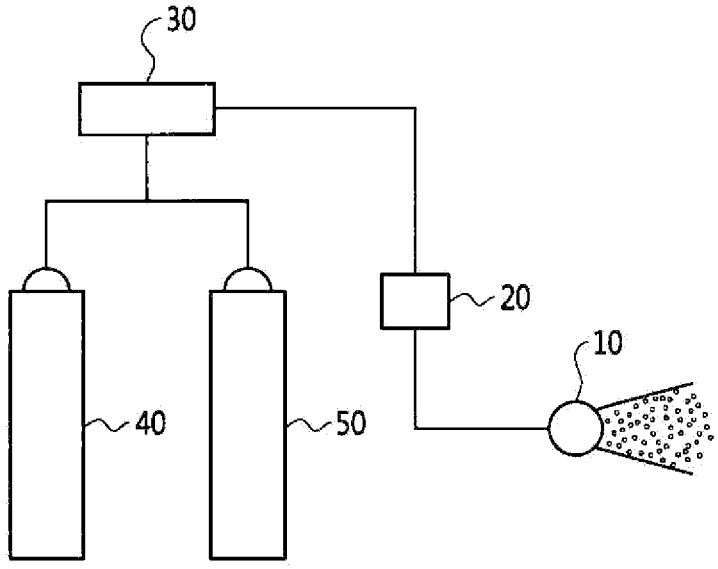
FIG. 4 is a view showing major parts configuring a device for generating high-speed uniform nanoparticles according to an embodiment of the present invention.
Figure 5:
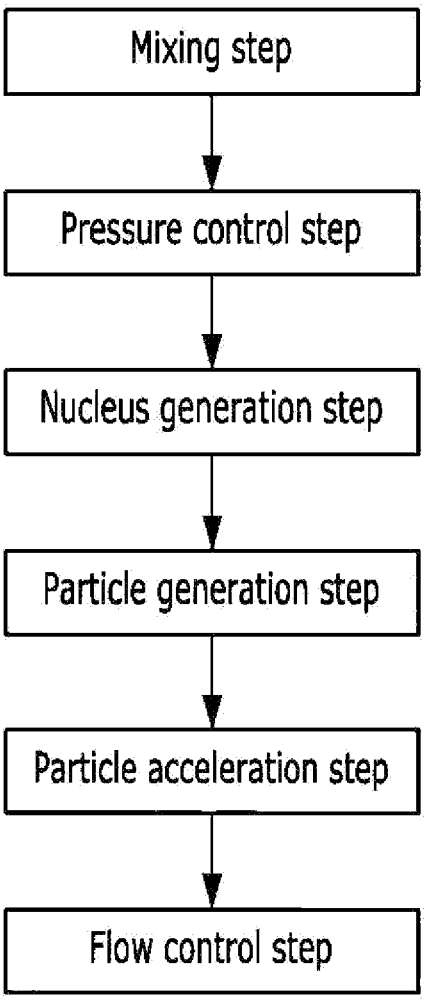
FIG. 5 is a flowchart illustrating a method of generating high-speed uniform nanoparticles using a mixture gas according to an embodiment of the present invention.
Figure 6:
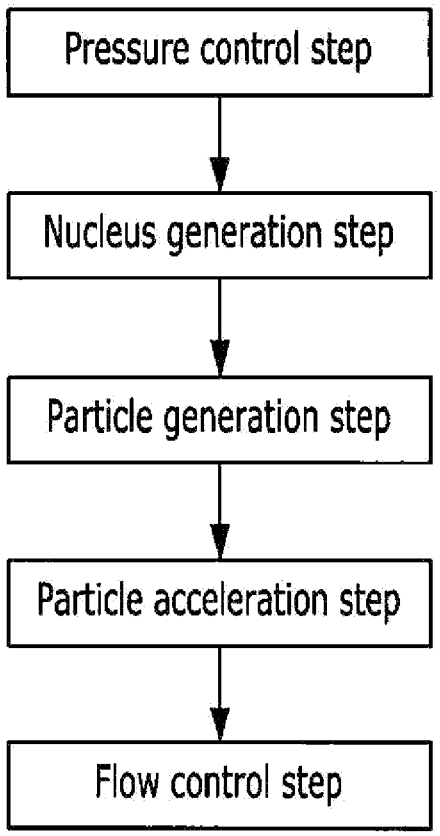
FIG. 6 is a flowchart illustrating a method of generating high-speed uniform nanoparticles using a pure particle generation gas according to an embodiment of the present invention.

FIG. 4 is a view showing major parts configuring a device for generating high-speed uniform nanoparticles according to an embodiment of the present invention.

A device for generating high-speed uniform nanoparticles according to the present invention may be divided into i) a case of using a mixture of a particle generation gas and a carrier gas and ii) a case of using only a particle generation gas.

First, i) in the case of using a mixture of a particle generation gas and a carrier gas, the device is configured to include a gas storage unit including a particle generation gas storage unit 40 and a carrier gas storage unit 50, a mixing chamber 30, a pressure controller 20 and a nozzle 10 as shown in FIG. 1.

In addition, ii) in the case of using only a particle generation gas, the device does not include the carrier gas storage unit 50 and a mixing unit.

In the case of using a mixture of a particle generation gas and a carrier gas, a particle generation gas storage unit 40 and a carrier gas storage unit 50 are connected to a mixing chamber 30. It is preferable that carbon dioxide is used as a particle generation gas as described above, and nitrogen or helium is used as a carrier gas. The mixing chamber 30 performs a function of sufficiently mixing the particle generation gas and the carrier gas and, at the same time, adjusting a mixing ratio. It is preferable that the mixing ratio is adjusted to form a carbon dioxide mixture gas by mixing the carrier gas with the particle generation gas to occupy 10 to 99% of the total volume of the mixture.

The mixture gas mixed in the mixing chamber 30 flows into a pressure controller 20. The pressure controller 20 controls pressure for supplying the mixture gas to the nozzle 10.

On the other hand, in the case of using only a particle generation gas formed of carbon dioxide, it may be considered to supply the particle generation gas to the pressure controller 20 by directly connecting the particle generation gas storage unit 40 to the pressure controller 20 without passing through the mixing chamber 30. Hereinafter, a particle generation gas of the case using only a particle generation gas will be referred to as a pure particle generation gas as a concept contrasting to the mixture gas.

In addition, it is preferable that output pressure at the pressure controller 20 is formed within a range of i) 5 to 120 bar in the case of the mixture gas and ii) 5 to 60 bar in the case of the pure particle generation gas, considering the size and injection speed of the generated sublimation particles.

The mixture gas or the pure particle generation gas passing through the pressure controller 20 is supplied to the inlet of the nozzle 10.

The mixture gas or the pure particle generation gas supplied to the inlet of the nozzle 10 sequentially passes through the orifice 12, the first dilating portion 14 and the second dilating portion 15 as described above, and the sublimation nano-particles are injected onto the object 1. Since the detailed internal structure of the nozzle 10 is described above, overlapped descriptions will be omitted.

Hereinafter, a method of generating high-speed uniform nanoparticles according to an embodiment of the present invention will be described.

A method of generating high-speed uniform nanoparticles according to an embodiment of the present invention corresponds to a method of generating high-speed uniform nanoparticles by passing a particle generation gas formed of carbon dioxide through the nozzle 10. Here, the particle generation gas may be mixed with the carrier gas and supplied to the nozzle of a mixture gas or may be supplied in the form of a pure particle generation gas.

First, when the particle generation gas is supplied in the form of a mixture gas, it is preferable to sequentially include a mixing step of forming the mixture gas by mixing the particle generation gas and the carrier gas and a pressure control step of adjusting pressure of the mixture gas passing through the mixing step.

Here, the carrier gas is formed of nitrogen or helium, and it is preferable to control the pressure of the mixture gas passing through the pressure control step to 5 to 120 bar and flow the mixture gas into the nozzle 10.

After performing the pressure control step, the nucleus generation step of generating nuclei is performed as the particle generation gas rapidly expands while passing through an orifice 12 provided in a nozzle throat 11 of the nozzle 10.

Then, after performing the nucleus generation step, the particle generation step of generating sublimation particles is performed as growth of nuclei is accomplished while the particle generation gas passes through a first dilating portion 14 extended from the outlet of the nozzle throat 11 and having a dilation angle $\theta_1$ of 0° to 30°.

Then, after performing the particle generation step, the particle acceleration step of offsetting growth of a boundary layer and increasing the speed of injecting the sublimation particles is performed as the particle generation gas passes through the second dilating portion 15 extended from the outlet of the first dilating portion 14 and having an average dilation angle $\theta_2$ increased by 10° to 45° compared with the dilation angle $\theta_1$ of the first dilating portion 14.

It is preferable to further include, after performing the particle acceleration step, the flow control step of forming a high-speed core of the sublimation particles outside the nozzle 10 as the particle generation gas passes through the third dilating portion 16 extended from the outlet of the second dilating portion 15 and having a dilation angle $\theta_3$ increased by 10° to 45° compared with the average dilation angle $\theta_2$ of the second dilating portion 15 and lower than 90° in maximum.

On the other hand, in the case of supplying only the pure particle generation gas, a pressure control step of adjusting the pressure of the particle generation gas is performed without performing the mixing step.

Here, it is preferable that pressure of the particle generation gas passing through the pressure control step is controlled to 5 to 60 bar to flow the particle generation gas into the nozzle 10.

The steps following thereafter are the same as the nucleus generation step, the particle generation step, the particle acceleration step and the flow control step.

The positional relations used to describe a preferred embodiment of the present invention are described focusing on the accompanying drawings, and the positional relations may be changed according to the aspect of an embodiment.

In addition, unless otherwise defined, all terms used in the present invention, including technical or scientific terms, have the same meanings as those generally understood by those with ordinary knowledge in the field of art to which the present invention belongs. In addition, the terms should not be interpreted to have ideal or excessively formal meanings unless clearly defined in the present application.

Although the preferred embodiment of the present invention has been described above, it should be regarded that embodiments simply aggregating prior arts with the present invention or simply modifying the present invention, as well as the present invention, also fall within the scope of the present invention.

INDUSTRIAL APPLICABILITY

The present invention may be applied for various purposes in a variety of fields requiring injection of high-speed sublimation particles, such as digging a groove of a nano-size, adjusting roughness of a surface and the like, as well as removing nano-pollutants.

The invention claimed is:

1. A nozzle for generating high-speed, uniform nanoparticles by passing a particle generation gas formed of carbon dioxide through the nozzle, the nozzle comprising:

a dilating portion of a shape increasing a cross-sectional area toward an outlet side of the nozzle; and an orifice provided at, an inlet of the dilating portion to expand the particle generation gas, wherein the dilating portion sequentially includes a first dilating portion and a second dilating portion, and an average dilation angle of the second dilating portion is wider than a dilation angle of the first dilating portion, wherein a connection portion for connecting the second dilating portion to the first dilating portion is formed to have a same dilation angle as the dilation angle of an outlet side of the first dilating portion, and wherein the connection portion is formed to gradually increase the dilation angle toward a center of the second dilating portion and decrease the dilation angle from the center toward the outlet side.

2. The nozzle according to claim 1, wherein the first dilating portion has a dilation angle of 0° to 30°, and the second dilating portion has an average dilation angle increased by 10° to 45° compared with the dilation angle of the first dilating portion.

3. The nozzle according to claim 2, further comprising a third dilating portion connected to an outlet of the second dilating portion, wherein the third dilating portion has a dilation angle increased by 10° to 45° compared with the average dilation angle of the second dilating portion and lower than 90° in maximum.

4. The nozzle according to claim 1, further comprising a heat insulation unit wrapping an outer surface of the nozzle.

5. A device for generating high-speed uniform nanoparticles by passing a particle generation gas formed of carbon dioxide through a nozzle, wherein the nozzle comprises a dilating portion having a cross-sectional area and a dilation angle increasing toward an outlet side of the nozzle, wherein the dilating portion sequentially includes a first dilating portion and a second dilating portion respectively having a dilation angle different from each other, and an average dilation angle of the second dilating portion is wider than a dilation angle of the first dilating portion, wherein the particle generation gas is supplied after being mixed with a carrier gas, and the device further comprises a mixing chamber for adjusting a mixing ratio between the particle generation gas and the carrier gas, wherein the carrier gas is formed of nitrogen, helium or air, and the mixing ratio is adjusted to make a volume ratio or mass ratio of the carrier gas between 10% and 99%, wherein the device further comprises a pressure controller for adjusting pressure of supplying a mixture gas formed by mixing the particle generation gas and the carrier gas, wherein the particle generation gas is supplied to the nozzle at a pressure of 5 bar to 120 bar, wherein a connection portion for connecting the second dilating portion to the first dilating portion is formed to have a same dilation angle as the dilation angle of an outlet side of the first dilating portion, and wherein the connection portion is formed to gradually increase the dilation angle toward a center of the second dilating portion and decrease the dilation angle from the center toward the outlet side.

6. The device according to claim 5, further comprising an orifice positioned at a nozzle throat of the nozzle to adjust an opening and closing cross-sectional area of the nozzle throat.

7. The device according to claim 5, wherein the first dilating portion has a dilation angle of 0° to 30°, and the second dilating portion has an average dilation angle increased by 10° to 45° compared with the dilation angle of the first dilating portion.

8. The device according to claim 7, further comprising a third dilating portion connected to an outlet of the second dilating portion, wherein the third dilating portion has a dilation angle increased by 10° to 45° compared with the average dilation angle of the second dilating portion and lower than 90° in maximum.

9. A device for generating high-speed uniform nano articles by passing a particle generation gas formed of carbon dioxide through a nozzle, wherein the nozzle comprises a dilating portion having a cross-sectional area and a dilation angle, increasing toward an outlet side of the nozzle, wherein the dilating portion sequentially includes a first dilating portion and a second dilating portion respectively having a dilation angle different from each other, and an average dilation angle of the second dilating portion is wider than a dilation angle of the first dilating portion, wherein the device further comprises a pressure controller for adjusting pressure of supplying the particle generation gas, wherein the particle generation gas is supplied to the nozzle at a pressure of 5 bar to 60 bar, wherein a connection portion for connecting the second dilating portion to the first dilating portion is formed to have a same dilation angle as the dilation angle of an outlet side of the first dilating portion, and wherein the connection portion is formed to gradually increase the dilation angle toward a center of the second dilating portion and decrease the dilation angle from the center toward the outlet side.

* * * * *